United States Patent [19]

Hutchison

[11] Patent Number: 4,833,858

[45] Date of Patent: May 30, 1989

[54] APPARATUS FOR JOINING WALL PANELS

[75] Inventor: Douglas Hutchison, St. Charles, Mo.

[73] Assignee: Dunmon Corporation, St. Louis, Mo.

[21] Appl. No.: 110,421

[22] Filed: Oct. 20, 1987

[51] Int. Cl.[4] ..... E04B 2/00

[52] U.S. Cl. ..... 52/762; 52/772

[58] Field of Search ..... 52/235, 280, 281, 283, 52/361, 363, 385, 401, 417, 461, 463, 465, 466, 468, 471, 481, 483, 509, 512, 582, 586, 714, 715, 762, 766, 781, 489

[56] References Cited

U.S. PATENT DOCUMENTS

| | | | |
|---|---|---|---|
| 2,735,523 | 2/1956 | Leyerle et al. | 52/509 |
| 3,339,329 | 9/1967 | Berg | 52/461 X |
| 3,471,187 | 10/1969 | Riseborough | 52/471 X |
| 3,667,182 | 6/1972 | Stemler | 52/497 |
| 3,832,820 | 9/1974 | Eggert | 52/762 |
| 3,971,075 | 7/1976 | Heinbaugh et al. | 52/461 X |
| 4,344,267 | 8/1982 | Sukolics | 52/762 |
| 4,452,029 | 6/1984 | Sukolics | 52/747 |

FOREIGN PATENT DOCUMENTS

| | | | |
|---|---|---|---|
| 1381143 | 2/1964 | France . | |
| 358577 | 1/1962 | Switzerland | 52/465 |

*Primary Examiner*—David A. Scherbel
*Assistant Examiner*—Creighton Smith
*Attorney, Agent, or Firm*—Bachman & LaPointe

[57] ABSTRACT

An apparatus for joining panel members into walls or divider is provided which does not require the use of a wet sealant to close the gap between adjacent panels and which allows thermal expansion and/or contraction of the panel members to be absorbed by the joints. The apparatus includes a channel for receiving turned down edges of adjacent panel members. The channel has interlocking portions for engaging mating portions on the panel edges and locking them into position. An insert is positioned within the channel between the edges to hold the interlocking and mating portions in engagement. The insert has protruding surfaces for wedging the portions together and a neck shaped portion for joining the insert to a cap or gasket for sealing the gap between the panel members. The cap or gasket includes a hollow interior portion for receiving the shaped portion of the insert and a pair of shoulders for retaining the shaped portion within the hollow portion.

15 Claims, 1 Drawing Sheet

APPARATUS FOR JOINING WALL PANELS

CROSS-REFERENCE TO RELATED APPLICATIONS

The present application is related to commonly assigned, co-pending application Ser. No. 110,174, filed on Oct. 19, 1987.

BACKGROUND OF THE INVENTION

The present invention relates to an apparatus for securing or joining metal panel members to building structures for forming walls and dividers. More particularly, the invention relates to constructions which eliminate the need for certain sealants between wall panels members and which allow thermal expansion of the wall panel members to be absorbed by the connecting apparatus without causing warping or distortion of the wall panel members.

Walls have been constructed in the past using panels with wedges for securely trapping and holding the edges of panel members in place. French Pat. No. 1,381,143 to Kentzler illustrates one such system. In many of these prior panel attaching systems, the edges of the panel members are securely locked into position in such a manner that thermal expansion of the panel members produces warping or other distortion in the panel members.

U.S. Pat. No. 3,667,182 to Stemler illustrates one panel attaching device in which a flexible strip of rubber, plastic or other resilient material is used to hold two adjacent panels in position within a channel. In this way, the panels are allowed a certain degree of lateral movement relative to the framing as they expand, contract, or are subjected to changes in load thereon. U.S. Pat. No. 3,832,820 to Eggert illustrates a similar panel mounting device in which a channel has edges formed in the shape of a hook, panels to be positioned within the channel have a corresponding hook shaped portion, and a strip of resilient material having a circular cross section is wedged in the channel to hold the hooks in interlocking relation.

U.S. Pat. Nos. 4,344,267 and 4,452,029, both to Sukolics, illustrate a panel securing apparatus which allows for thermal expansion of the panel members. The apparatus comprises a channel member having sidewalls with integral semi-cylindrical locking portions adapted to engage similarly shaped portions on the edges of panels to be positioned within the channel. To hold and lock the panel edges within the channel, a rigid member having protrusions is inserted between the panel members.

Many of these panel securing systems are known as wet set systems because of their use of sealants such as silicone sealants to seal the gaps in exterior walls. In these systems, the sealant when exposed to the atmosphere, in some environments, collects dirt and allows it to spread across the panel faces rendering them aesthetically unappealing. To overcome this problem, it has been proposed to replace the "wet" sealant exposed to the atmosphere by a dry sealant.

Accordingly, it is an object of the present invention to provide a panel securing apparatus which does not require the use of an external wet sealant to close the gap between adjacent panels forming an exterior wall.

It is a further object of the present invention to provide a panel securing apparatus as above which also allows for thermal expansion and/or contraction of adjoining panel members.

It is yet another object of the present invention to provide a panel securing apparatus as above which permits the panel members to retain an aesthetically pleasing appearance.

These and other objects and advantages will become more apparent from the following description and drawings in which like reference numerals depict like elements.

SUMMARY OF THE INVENTION

In accordance with the present invention, the apparatus for joining adjacent panel members together comprises a channel having a base portion and a pair of sidewalls for receiving turned down edges of two side by side, spaced apart panel members, means for interlocking said panel edges and said channel sidewalls, means for sealing the space between the panel members, an insert positioned within the channel between the panel edges having means protruding from its sides for wedging the edges of said panel members against said interlocking means and means for joining said insert and sealing means together. In a preferred construction, the sealing means has a hollow interior portion and the joining means comprises a shaped member adapted to be inserted into said hollow portion. The sealing means further includes a pair of shoulders for engaging a neck portion of said insert and for retaining the shaped member within the hollow portion. The sealing means may be formed from an elastomeric material such as an extruded rubber material or a rigid plastic or metal material. The insert along with its neck portion and shaped member may be formed from a rigid metal or non-metallic material.

DETAILED DESCRIPTION

Figure 1:
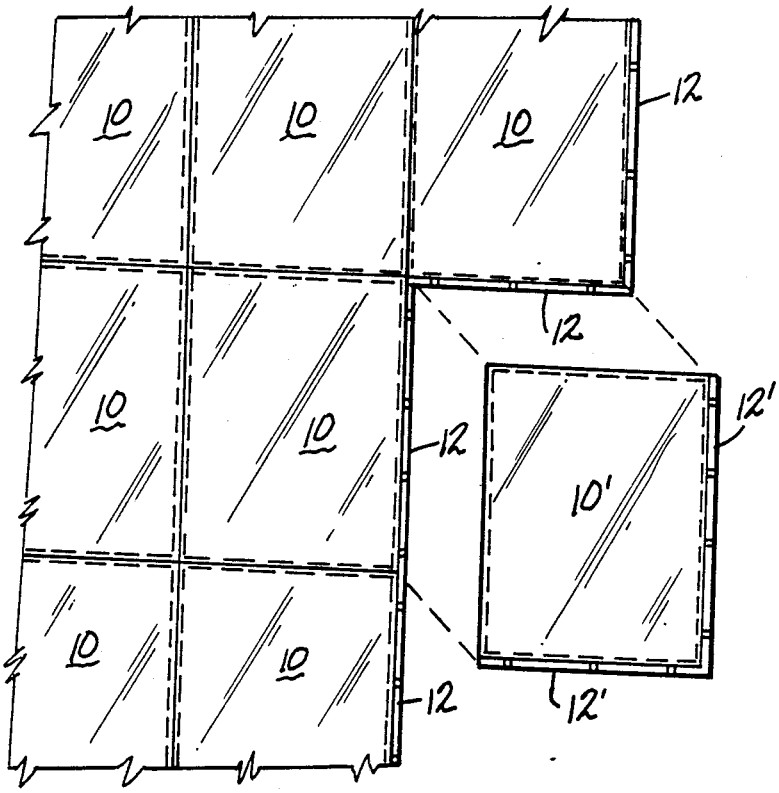
FIG. 1 is a perspective view illustrating a portion of a wall made up of a plurality of joined panel members.

FIG. 1 shows a wall composed of several panel members 10 which are held together by channel members 12 as described below. Panel members 10 may be any metal, plastic or composite panel which may be formed and machined as shown.

Channel members 12 are secured to a building structure by suitable fastening means such as screws. If desired, members 12 may be previously laid out in a grid type fashion. In the embodiment shown in FIG. 1, channel members 12' are loosely attached to two of the four edges of panel member 10'. The two edges of panel member 10' not having channels 12' attached may be inserted into matching channels 12 already secured to the building structure. After the panel members 10' have been positioned, channel members 12' may be secured to the building structure. This method alleviates the need to accurately locate and secure a grid to the building structure before assembling panel members 10 into a wall.

Figure 2:
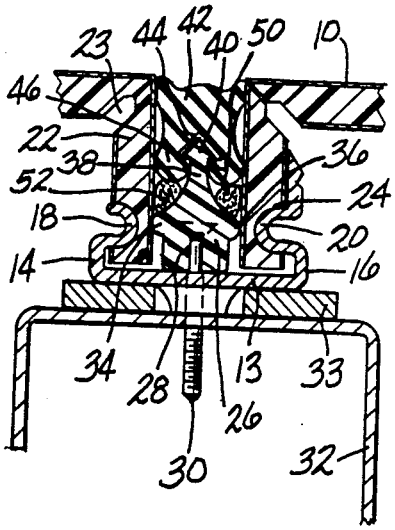
FIG. 2 is a cross-sectional view of a panel joining apparatus in accordance with a first embodiment of the present invention.

FIG. 2 shows the construction of a first embodiment of the present invention. As shown therein, channel member 12 has a substantially U-shaped configuration with a base portion 13, a short side 14 and a long side 16. Short side 14 has a panel interlock 18 on its inner side in the form of a ridge running longitudinally along the length of the side. A panel interlock 20 is also formed on the inner side of the long side 16 also in the form of a ridge running longitudinally along the length of the side. The interlocks 18 and 20 each preferably have a substantially semi-cylindrical shape. Channel member 12 may be made of any suitable material known in the art including but not limited to metals such as aluminum or an aluminum alloy.

Edges 22 of side by side, spaced apart panel member 10 are turned down such that they may be inserted into channel member 12. Grooves 24, also preferably having a substantially semi-cylindrical configuration, are provided longitudinally along the inner sides of turned down edges 22. The grooves 24 are sized to accept interlocks 18 and 20 of sides 14 and 16 of channel 12.

The edges 22 of the panel members 10 are sized such that there is a slight space between the ends of the edges 22 and the base portion 13 of channel member 12. By sizing the edges in this way, the panel members can accommodate rotation of the edges around interlocks 18 and 20 when subjected to thermal expansion or contraction. The rotation action is further enhanced by providing reduced areas 23 at the inner corner where panel members 10 join turned down edges 22. Areas 23 may be provided by machining or stamping with an appropriate die as panel members 10 are being formed.

To maintain the grooves 24 in cooperation with interlocks 18 and 20, an insert strip 26 is positioned within the channel 12 between turned down edges 22. While insert strip 26 may be formed from any suitable metallic or non-metallic material, it is preferred that it be formed from a rigid vinyl material. A series of holes 28 may be provided along the length of the strip 26 to accommodate fastening means 30 such as screws for joining the insert 26 to the channel 12 and/or a support structure 32 having a plate 33 which acts as a dimensional adjustment spacer and/or an electrical insulator between the dissimilar materials forming the insert 26 and the structure 32. The fastening means 30 also serve to prevent collapse of the vinyl insert and release of the interlocks 18 and 20 from grooves 24.

Protrusions 34 and 36 are provided along the sides of insert 26 and positioned such that when insert 26 is fastened in place by screws 30, protrusions 34 and 36 are behind interlocks 18 and 20, respectively. These protrusions assist in maintaining grooves 24 over interlocks 18 and 20 while allowing pivotal movement of edges 22 around 18 and 20.

The insert 26 is further characterized by a neck portion 38 and a shaped member 40 which together form a means for joining the insert 26 to the means 42 for sealing the space between the two adjoining panels and preventing the infiltration of water, dirt, and the like due to atmospheric conditions. The sealing means 42 has a hollow interior portion or pocket 44 for receiving the shaped member 40. The sealing means 42 also is characterized by a pair of shoulders 46 for engaging the neck portion 38 of the insert 26 and shoulder surfaces 48 for contacting surfaces or a portion of the shaped member 40 and for retaining the shaped member 40 in position relative to the sealing means.

The sealing means 42 may be formed from any suitable metallic or non-metallic material. For example, it may be formed from an elastomeric material such as an extruded rubber gasket. Alternatively, it may be formed from a rigid aluminum material or a plastic material. When formed from a plastic material, the sealing means may be a plastic snap cap wherein the shoulders 46 act as snap elements.

As shown in FIG. 2, the shaped member 40 may have a substantially triangular or arrowhead like profile, and the pocket 44 may have a substantially identical shape. When such a shaped member 40 is used, it is preferred to form the sealing means 42 from an extruded rubber gasket so that the shoulder surfaces 48 may positively engage the lower surface or flukes 50 of the shaped member.

Figure 4:
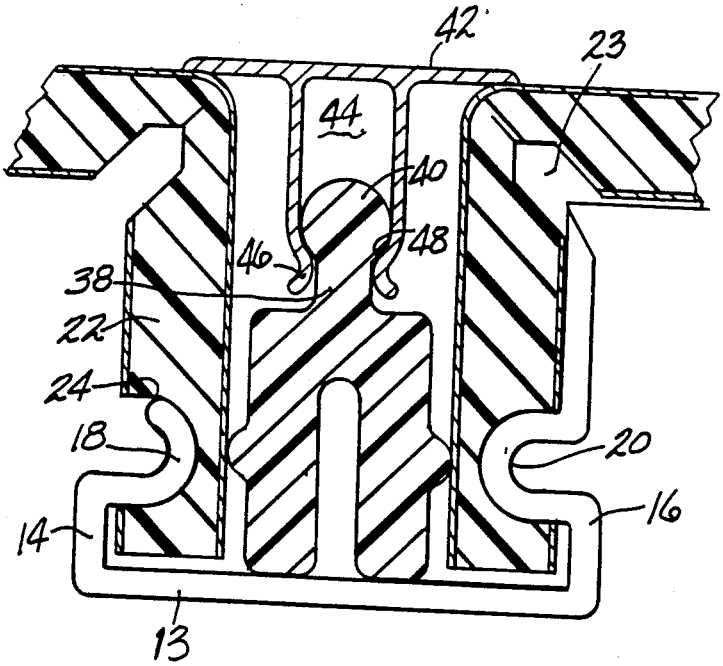
FIG. 4 is a cross-sectional view of a panel joining apparatus in accordance with yet another embodiment of the present invention.
Figure 3:
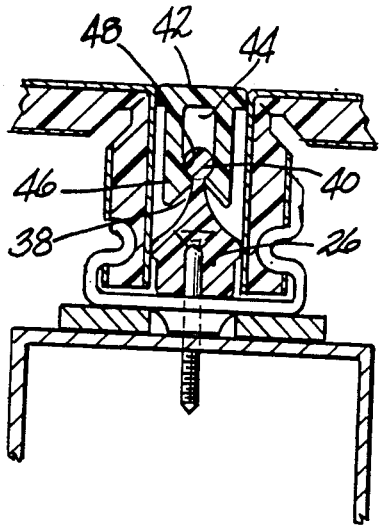
FIG. 3 is a cross-sectional view of a panel joining apparatus in accordance with a second embodiment of the present invention.

Alternatively, the shaped member 40 may have a substantially spherical or round ball-like profile as shown in FIGS. 3 and 4. When such a profile is used, the sealing means 42 is preferably formed from a rigid aluminum or plastic snap cap which can be forced down over the round profile of the shaped member.

As shown in FIG. 3, the neck portion 38 may be tapered if desired. Alternatively, the neck portion 38 may have a substantially constant width as shown in FIG. 4.

When the panel joining apparatus is to be used in forming an exterior building wall, one or more beads 52 of sealant may be placed between the panel edges 22 and between the sealing means 42 and insert strip 26 to help prevent water infiltration. The sealing means 42 in this instance separates the sealant from the outside atmosphere. When the panel joining apparatus is to be used in forming an interior building wall, the sealant beads 52 may be omitted.

As can be seen from the foregoing discussion, a panel joining apparatus has been provided which does not utilize external wet sealants such as silicone sealants which when exposed to atmospheric conditions collect dirt and allow it to spread across the faces of the adjoining panels rendering them aesthetically unappealing. The apparatus also accommodated thermal expansion and/or contraction of the panel members.

It is apparent that there has been provided in accordance with this invention an apparatus for joining wall panels which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus for joining panel members together which comprises a channel for receiving turned down edges of two side by side, spaced apart panel members, said channel having a base portion and a pair of sidewalls, means for interlocking said panel edges and said channel sidewalls, a sealing member in contact with each panel member for sealing the space between said panel members, an insert positioned within said channel between said edges, and said insert having means protruding from its sides for wedging the edges of said panel members against said interlocking means and means for joining said insert and said sealing member together.

2. An apparatus as in claim 1 wherein said sealing member has a hollow interior portion and said joining means comprises a shaped member to be inserted into said hollow interior portion.

3. An apparatus as in claim 2 wherein said insert further has a neck portion and said sealing member has a pair of shoulders for engaging said neck portion and retaining said shaped member within said hollow portion.

4. An apparatus as in claim 3 wherein said hollow interior portion has a substantially triangular shape, said shaped member has a substantially triangular shape, and said shoulders have surfaces for engaging at least one surface of said shaped member.

5. An apparatus as in claim 3 wherein said shaped member is formed by a substantially spherical body and said shoulders have surfaces for engaging a portion of said substantially spherical body.

6. An apparatus as in claim 3 wherein said sealing member is formed from an elastomeric material.

7. An apparatus as in claim 3 wherein said sealing member comprises an extruded rubber gasket.

8. An apparatus as in claim 3 wherein said insert, said member and shaped said neck portion are formed from a rigid vinyl material.

9. An apparatus as in claim 3 wherein said sealing member comprises a rigid aluminum cap and said shoulders comprise snap elements.

10. An apparatus as in claim 3 wherein said sealing member comprises a plastic snap cap and said shoulders comprise snap elements.

11. An apparatus as in claim 3 which further comprises at least one sealant bead between said panel edges and between said sealing member and said insert for preventing water infiltration.

12. An apparatus as in claim 1 wherein said interlocking means comprises a shaped portion on each said channel sidewall and a mating portion on each said panel edge and wherein said protruding means wedges said portion together and permits pivotal movement of said panel member edges positioned in said channel about said interlocking means and thereby permitting thermal expansion of panel members.

13. An apparatus as in claim 1 which further comprises means for fastening said insert into said channel.

14. An apparatus as in claim 1 wherein said protruding means comprises a ridge along each side of said insert.

15. An apparatus as in claim 4 wherein said shaped member has an arrow point shape and said shoulder surfaces engage the flukes of said arrow point shape.

* * * * *